US007927231B2

(12) United States Patent
Sato et al.

(10) Patent No.: US 7,927,231 B2
(45) Date of Patent: Apr. 19, 2011

(54) GOLF CLUB HEAD

(75) Inventors: Fumiaki Sato, Chichibu (JP); Hiroshi Takahashi, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 12/645,872

(22) Filed: Dec. 23, 2009

(65) Prior Publication Data

US 2010/0331101 A1 Dec. 30, 2010

(30) Foreign Application Priority Data

Jun. 26, 2009 (JP) ..... 2009-152086

(51) Int. Cl.
*A63B 53/04* (2006.01)
*A63B 53/06* (2006.01)

(52) U.S. Cl. ..... 473/334; 473/336; 473/345

(58) Field of Classification Search ..... 473/324–350, 473/256

See application file for complete search history.

(56) References Cited

U.S. PATENT DOCUMENTS

| | | | | |
|---|---|---|---|---|
| 1,453,503 | A * | 5/1923 | Holmes | 473/336 |
| 2,171,383 | A * | 8/1939 | Wettlaufer | 473/335 |
| 2,460,445 | A * | 2/1949 | Bigler | 473/242 |
| 3,199,874 | A * | 8/1965 | Blasing | 473/244 |
| 3,589,731 | A * | 6/1971 | Chancellor, Jr. | 473/333 |
| 3,606,327 | A * | 9/1971 | Gorman | 473/297 |
| 3,610,630 | A * | 10/1971 | Glover | 473/338 |
| 3,680,868 | A * | 8/1972 | Jacob | 473/328 |
| 3,979,122 | A * | 9/1976 | Belmont | 473/336 |
| 4,206,924 | A | 6/1980 | Koralik | |
| 4,340,230 | A | 7/1982 | Churchward | |
| 4,754,977 | A | 7/1988 | Sahm | |
| 4,867,458 | A | 9/1989 | Sumikawa et al. | |
| 4,869,507 | A | 9/1989 | Sahm | |
| 4,895,371 | A * | 1/1990 | Bushner | 473/336 |
| 5,195,747 | A | 3/1993 | Choy | |
| 5,489,097 | A * | 2/1996 | Simmons | 473/326 |
| 5,518,243 | A | 5/1996 | Redman | |
| 5,603,665 | A * | 2/1997 | Bryant | 473/230 |
| 5,613,916 | A | 3/1997 | Sommer | |
| 5,688,189 | A * | 11/1997 | Bland | 473/314 |
| 6,277,032 | B1 * | 8/2001 | Smith | 473/336 |
| 6,348,014 | B1 | 2/2002 | Chiu | |
| 6,749,523 | B1 | 6/2004 | Forzano | |
| 6,773,360 | B2 | 8/2004 | Willett et al. | |

(Continued)

FOREIGN PATENT DOCUMENTS

JP 9-28844 A 2/1997

(Continued)

*Primary Examiner* — Sebastiano Passaniti
(74) *Attorney, Agent, or Firm* — Sughrue Mion, PLLC

(57) ABSTRACT

A golf club head according to this invention includes a hollow head body, cylindrical body, weight member, and fixing member. The hollow head body has a projection formed along the periphery of the sole, a recess formed inside the projection, and an opening formed in the projection so as to extend from the toe side to the back side. The cylindrical body is provided in the recess of the head body, and includes its one end which engages with the inner wall of the projection on the heel side, and its other end which extends to the vicinity of the opening and can move along the opening. The weight member is retractably, detachably inserted in the cylindrical body. The fixing member is a detachable member which fixes the other end of the cylindrical body onto the projection.

4 Claims, 3 Drawing Sheets

U.S. PATENT DOCUMENTS

| | | | | |
|---|---|---|---|---|
| 6,923,734 | B2 * | 8/2005 | Meyer | 473/336 |
| 7,056,228 | B2 | 6/2006 | Beach et al. | |
| 7,147,573 | B2 | 12/2006 | DiMarco | |
| 7,166,040 | B2 | 1/2007 | Hoffman et al. | |
| 7,186,190 | B1 | 3/2007 | Beach et al. | |
| 7,223,180 | B2 | 5/2007 | Willett et al. | |
| 7,247,103 | B2 | 7/2007 | Beach et al. | |
| 7,351,161 | B2 * | 4/2008 | Beach | 473/334 |
| 7,407,447 | B2 | 8/2008 | Beach et al. | |
| 7,410,425 | B2 | 8/2008 | Willett et al. | |
| 7,410,426 | B2 | 8/2008 | Willett et al. | |
| 7,419,441 | B2 | 9/2008 | Hoffman et al. | |
| 7,448,963 | B2 | 11/2008 | Beach et al. | |
| 7,452,285 | B2 | 11/2008 | Chao et al. | |
| 7,530,904 | B2 | 5/2009 | Beach et al. | |
| 7,540,811 | B2 | 6/2009 | Beach et al. | |
| 7,568,985 | B2 | 8/2009 | Beach et al. | |
| 7,578,753 | B2 | 8/2009 | Beach et al. | |
| 7,591,738 | B2 | 9/2009 | Beach et al. | |
| 2004/0087388 | A1 | 5/2004 | Beach et al. | |
| 2005/0181884 | A1 | 8/2005 | Beach et al. | |
| 2007/0105646 | A1 | 5/2007 | Beach et al. | |
| 2007/0105648 | A1 | 5/2007 | Beach et al. | |
| 2007/0105651 | A1 | 5/2007 | Beach et al. | |
| 2007/0105654 | A1 | 5/2007 | Beach et al. | |
| 2007/0249432 | A1 * | 10/2007 | Wu | 473/340 |
| 2008/0261717 | A1 | 10/2008 | Hoffman et al. | |
| 2008/0280698 | A1 | 11/2008 | Hoffman et al. | |

FOREIGN PATENT DOCUMENTS

| | | | |
|---|---|---|---|
| JP | 11-9742 | A | 1/1999 |
| JP | 2003-38689 | A | 2/2003 |
| JP | 2006-505367 | A | 2/2006 |
| JP | 2006-187489 | A | 7/2006 |
| JP | 2006-280439 | A | 10/2006 |
| JP | 2006-320493 | A | 11/2006 |
| JP | 2007-136068 | A | 6/2007 |
| JP | 2008-173314 | A | 7/2008 |
| WO | 2004/043549 | A1 | 5/2004 |

* cited by examiner

GOLF CLUB HEAD

BACKGROUND OF THE INVENTION

1. Field of the Invention

The present invention relates to a hollow golf club head having both a variable center-of-gravity position and a variable weight.

2. Description of the Related Art

Japanese Patent Laid-Open No. 9-28844 proposes a conventional hollow golf club head having a variable center-of-gravity position. The hollow golf club head disclosed in Japanese Patent Laid-Open No. 9-28844 is configured such that a weight member which is threadably fitted on a threaded rod can be moved and adjusted in one of the forward, backward, left, right, upward, and downward directions of a hollow metal head body by inserting the weight member into the hollow portion of the metal head body, and rotating the threaded rod.

The golf club head disclosed in Japanese Patent Laid-Open No. 9-28844 mentioned above includes a mechanism which adjusts the weight of the hollow metal head body to be formed by rotating the threaded rod to move the weight member into the hollow portion of the metal head body. With this mechanism, in adjusting the center-of-gravity position of the metal head body after forming the metal head body, the characteristics of the golf club can be continuously changed with little change in total weight and swing weight balance of the golf club by rotating the threaded rod to move and adjust the weight member in the forward, backward, left, right, upward, and downward directions of the metal head body.

Unfortunately, the golf club head disclosed in Japanese Patent Laid-Open No. 9-28844 has an invariable weight although it has a variable center-of-gravity position.

To change the center-of-gravity position of a golf club head using a weight member, the center of gravity of the golf club head can be set at the same position using either a method of concentrated loading by disposing a weight member at one position, or a method of distributed loading by disposing weight members at a plurality of positions. However, the golf club head disclosed in Japanese Patent Laid-Open No. 9-28844 can employ only the former concentrated loading method.

SUMMARY OF THE INVENTION

The present invention has been made in consideration of the above-mentioned situation, and has as its first object to provide a golf club head having both a variable center-of-gravity position and a variable weight.

The present invention also has as its second object to provide a golf club head which can employ both a method of concentrated loading by disposing a weight member at one position, and a method of distributed loading by disposing weight members at a plurality of positions in order to change the center-of-gravity position of the golf club head.

In order to achieve the above-mentioned first object, according to the present invention, there is provided a golf club head comprising a hollow head body including a projection formed along a periphery of a sole, a recess formed inside the projection, and an opening formed in the projection so as to extend from a toe side to a back side, a cylindrical body which is provided in the recess of the head body, includes one end that engages with an inner wall of the projection on a heel side, and the other end that extends to a vicinity of the opening and can move along the opening, a weight member retractably, detachably inserted in the cylindrical body, and a detachable fixing member which fixes the other end of the cylindrical body onto the projection.

Also, in order to achieve the above-mentioned first object, according to the present invention, there is provided a golf club head comprising a hollow head body including a projection formed along a periphery of a sole, a recess formed inside the projection, an opening formed in the projection so as to extend from a toe side to a back side, a thread formed on an inner wall of the opening, and at least one groove portion formed in an inner wall of the projection on a heel side, a cylindrical body which is provided in the recess of the head body, includes one end inserted in the groove portion, the other end that extends to a vicinity of the opening and can move along the opening, and a thread formed on an inner wall thereof, a weight member which includes a thread formed on an outer wall thereof and retractably, detachably engages with the thread on the inner wall of the cylindrical body, and a detachable fixing screw which engages with the thread in the opening from outside the projection, and presses the other end of the cylindrical body to push the one end of the cylindrical body against the groove portion, thereby fixing the cylindrical body onto the projection.

Moreover, in order to achieve the above-mentioned second object, according to the present invention, there is provided the golf club head of the present invention described above, wherein a plurality of weight members retractably, detachably engage with a thread on an inner wall of the cylindrical body.

In the golf club head according to the present invention, the weight member is retractably provided in the cylindrical body, the opening is formed in the projection of the head body, and the position to fix the other end of the cylindrical body onto the projection can be changed along the opening. Hence, the center-of-gravity position and, more specifically, one or both of the center-of-gravity distance and the center-of-gravity angle can be changed by changing the position of the weight member in the cylindrical body or changing the position to fix the other end of the cylindrical body onto the projection. Note that the center-of-gravity distance means the distance from the shaft line to the center of gravity, and the center-of-gravity angle means the angle between the face and a straight line which passes through the center of the distal end of the shaft and the center of gravity.

Also, in the golf club head according to the present invention, the weight member is detachably provided in the cylindrical body. Hence, the head weight can be changed by exchanging weight members which have different weights and are provided into the cylindrical body.

Moreover, when a plurality of weight members are provided in the cylindrical body, the above-mentioned concentrated loading can be performed by disposing the plurality of weight members at one position in the cylindrical body, and the above-mentioned distributed loading can be performed by disposing a plurality of weight members with spacings between them in the cylindrical body.

Further features of the present invention will become apparent from the following description of exemplary embodiments with reference to the attached drawings.

DESCRIPTION OF THE EMBODIMENTS

Figure 1:
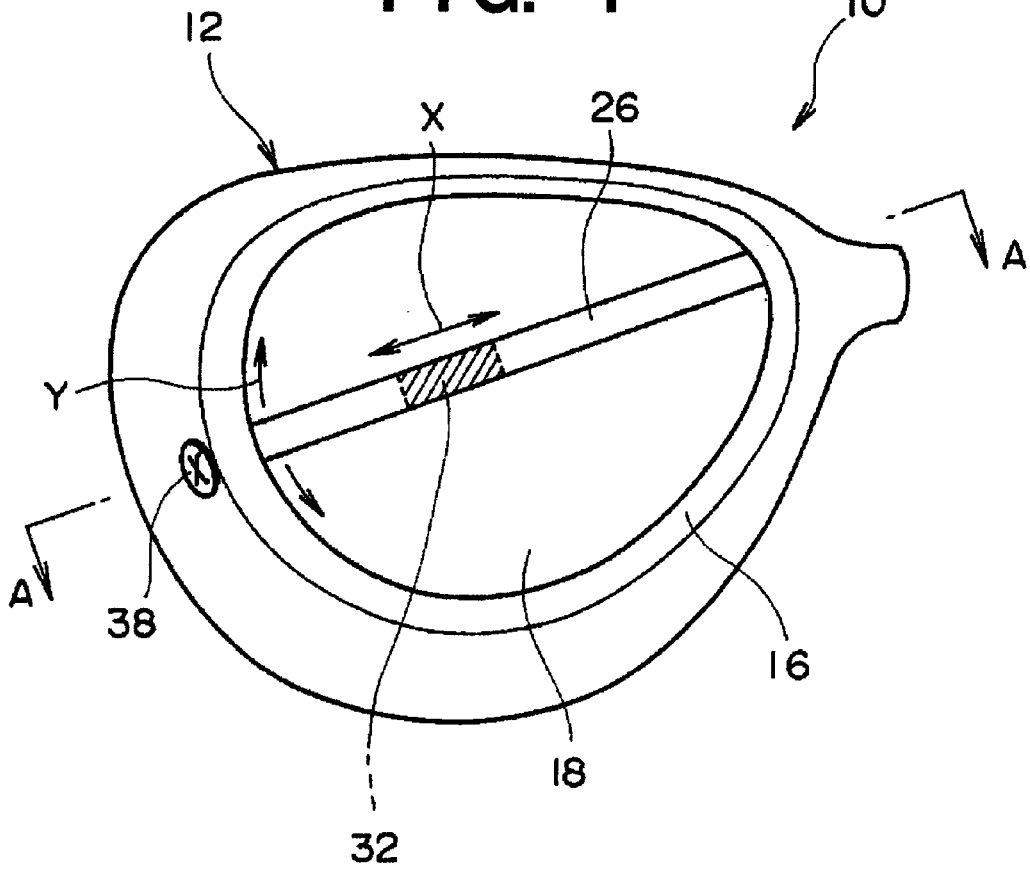
FIG. 1 is a bottom view illustrating one embodiment of a golf club head according to the present invention when viewed from the sole side.
Figure 2:
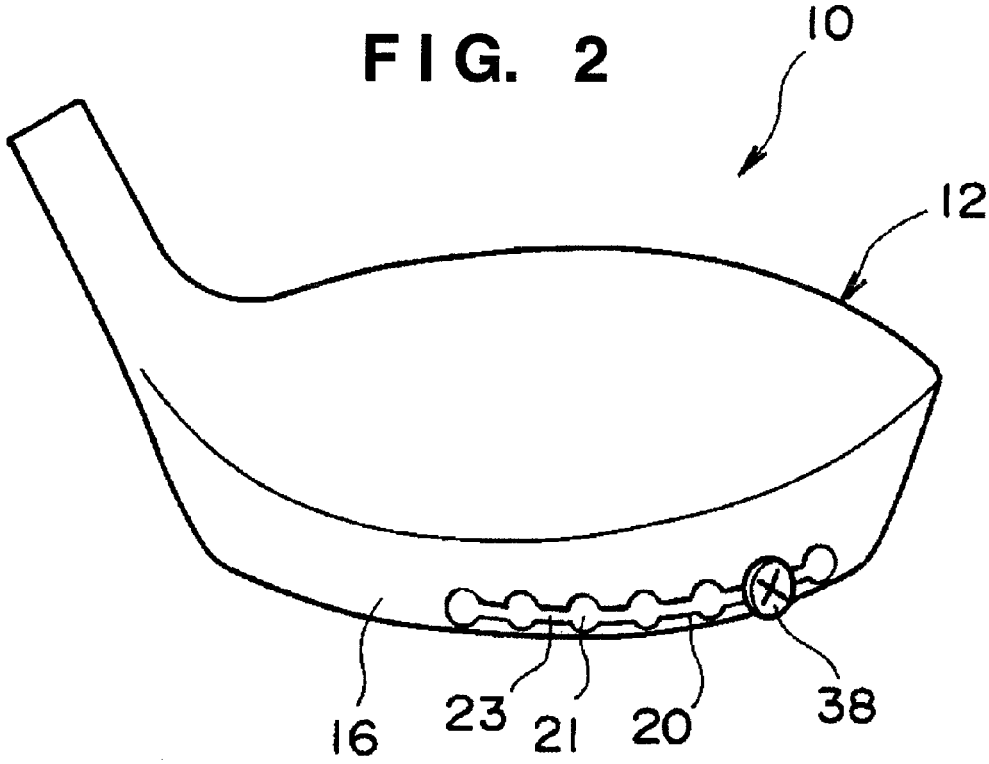
FIG. 2 is a back view of the golf club head shown in FIG. 1 when viewed from the back side.
Figure 3:
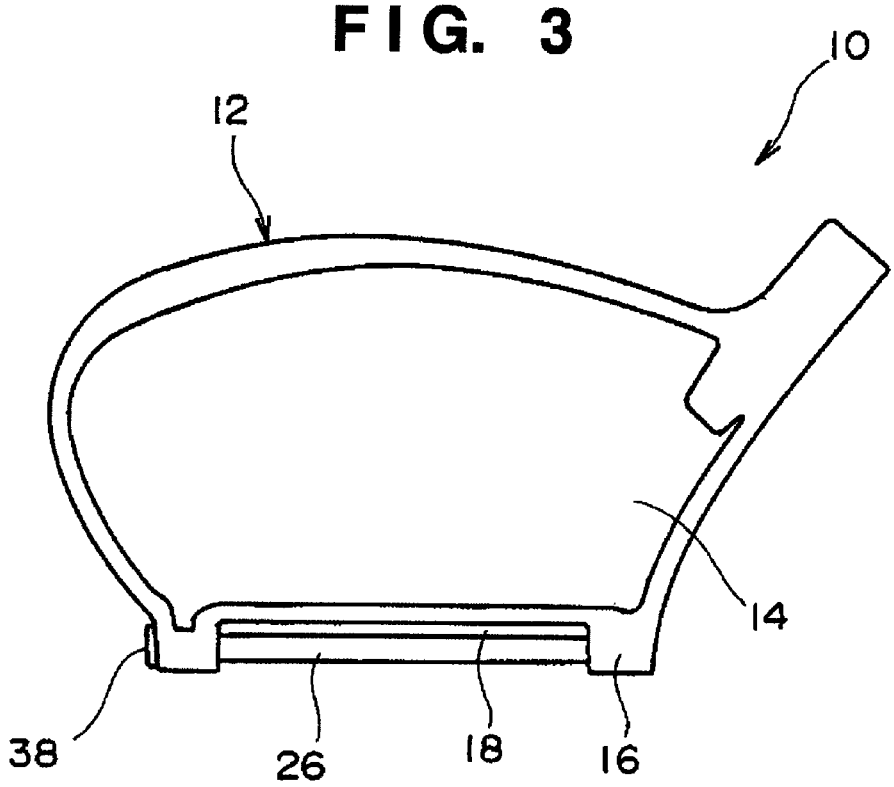
FIG. 3 is a sectional view taken along a line A-A in FIG. 1.

The present invention will be described in detail below with reference to the accompanying drawings. FIGS. 1 to 3 are views illustrating one embodiment of a golf club head according to the present invention, in which FIG. 1 is a bottom view when viewed from the sole side; FIG. 2 is a back view when viewed from the back side; and FIG. 3 is a sectional view taken along a line A-A in FIG. 1. Also, FIG. 4 is a schematic sectional view showing the state in which a cylindrical body is fixed onto a projection of a head body, and FIG. 5 is a perspective view showing a weight member.

A golf club head 10 in this embodiment has a head body 12. The head body 12 has a hollow portion 14, a roughly elliptical projection 16 formed along the periphery of the sole, and a recess 18 formed inside the projection 16. An opening 20 is formed in the projection 16 so as to extend in the horizontal direction from the toe side to the back side. Internal threaded portions 21 are formed in the opening 20 by shaping the opening 20 into circles at a predetermined interval. Threads 22 are formed on the inner wall of the internal threaded portion 21, as shown in FIG. 4. The internal threaded portions 21 are connected to each other via a through hole 23 having a narrow opening width. A rounded groove (groove portion) 24 into which one end of a cylindrical body (to be described later) is inserted is formed in the inner wall of the projection 16 on the heel side, as shown in FIG. 4. Although not shown, a plurality of (typically, three to six) rounded grooves 24 are juxtaposed in the horizontal direction with predetermined spacings between them. The material of the head body is not particularly limited, and it can be made of, for example, a metal such as titanium, a titanium alloy, stainless steel, aluminum, an aluminum alloy, beryllium copper alloy, or a magnesium alloy, or a fiber-reinforced resin.

Figure 4:
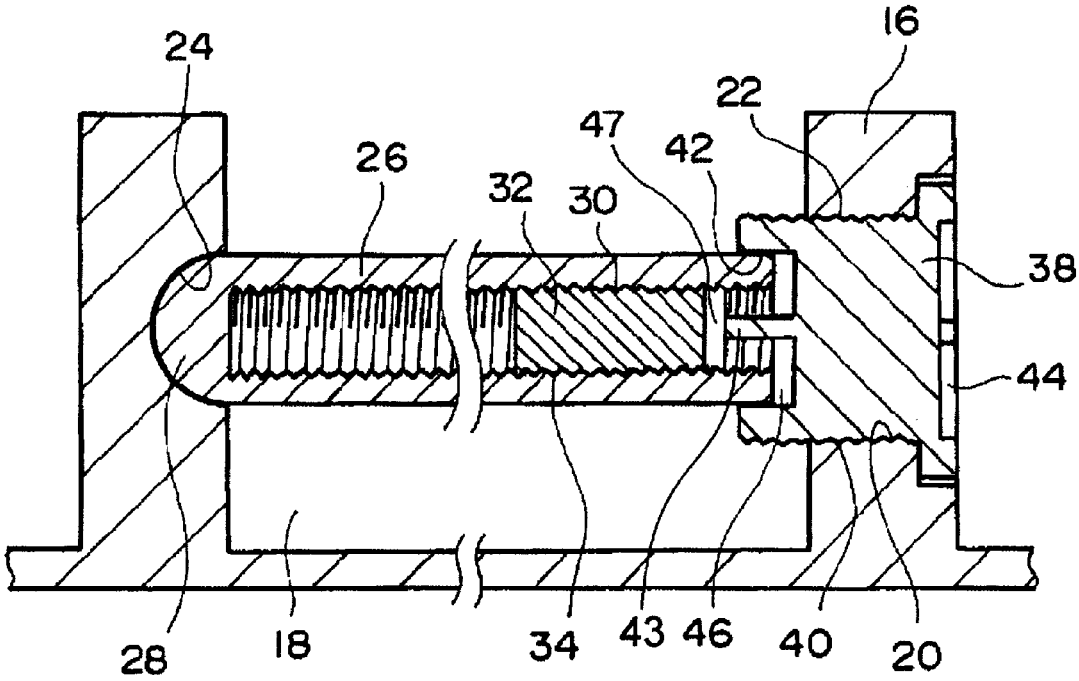
FIG. 4 is a schematic sectional view showing the state in which a cylindrical body is fixed onto a projection of a head body.
Figure 5:
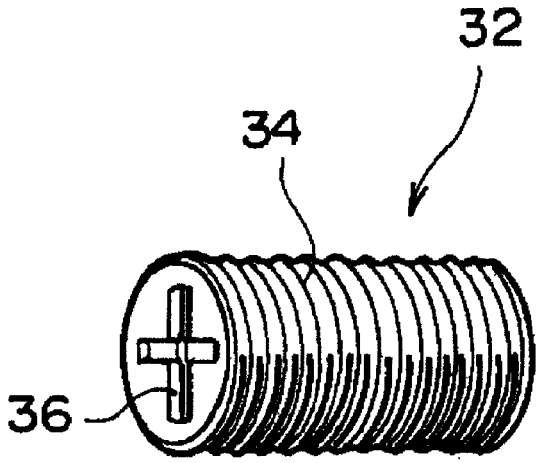
FIG. 5 is a perspective view showing a weight member.

In FIG. 4, reference numeral 26 denotes a cylindrical body provided in the recess 18 of the head body 12. The cylindrical body 26 has a roughly cylindrical shape. The cylindrical body 26 has its one end with a semispherical insertion portion 28 inserted in the rounded groove 24 mentioned above, and its other end which extends to the vicinity of the opening 20 mentioned above and can move along the opening 20. The shape of the above-mentioned insertion portion is not limited to a specific one, and it can have an arbitrary shape such as a trapezoidal vertical cross-section or a quadrangular vertical cross-section. Threads 30 are formed on the inner wall of the cylindrical body 26, as shown in FIG. 4. The material of the cylindrical body is not particularly limited, and it can be made of, for example, a metal such as stainless steel, titanium, a titanium alloy, aluminum, or an aluminum alloy, or a plastic such as polyester or nylon.

In FIG. 4, reference numeral 32 denotes a weight member provided in the cylindrical body 26. The weight member 32 has a cylindrical shape, threads 34 formed on its outer wall, and a Phillips head or slotted screwdriver insertion groove 36 formed in its head. The weight member 32 retractably, detachably threadably engages with the threads 30 on the inner wall of the cylindrical body 26. In this embodiment, one weight member 32 is provided in the cylindrical body 26. The material of the weight member is not particularly limited, and it can be made of, for example, a metal such as tungsten, a tungsten alloy, stainless steel, aluminum, or an aluminum alloy or a plastic such as polyester or nylon. The specific gravity of the weight member is preferably 0.9 to 19.3. Also, portions other than the position where the weight member is placed in the cylindrical body can be filled with an elastic body such as sponge to prevent the weight member from moving within the cylindrical body.

In FIG. 4, reference numeral 38 denotes a detachable fixing screw. The fixing screw 38 has threads 40 formed on the outer wall of its shank, a circular groove 42 into which the other end of the cylindrical body 26 is inserted and which is formed in the bottom wall of its shank, a core 43 formed in the bottom of the circular groove 42, and a Phillips head or slotted screwdriver insertion groove 44 formed in its head, as shown in FIG. 4. When the fixing screw 38 rotates while it threadably engages with the threads 22 in the opening 20 from outside the projection 16 and the other end of the cylindrical body 26 is inserted in the circular groove 42, the bottom of the circular groove 42 of the fixing screw 38 presses the other end of the cylindrical body 26 to push one end of the cylindrical body 26 against the rounded groove 24, thereby fixing the cylindrical body 26 onto the projection 16. A ring-like washer 46 made of an elastic material is disposed in the bottom of the circular groove 42. A circular elastic body 47 is interposed between the weight member 32 and the core 43 of the fixing screw 38. The elastic body 47 presses the weight member 32 to prevent it from moving within the cylindrical body 26 during, for example, a swing. The material of the fixing screw is not particularly limited, and it can be made of, for example, a metal such as stainless steel, aluminum, an aluminum alloy, titanium, a titanium alloy, or a magnesium alloy, or a plastic such as polyester or nylon.

The center-of-gravity position of the golf club head 10 in this embodiment can be changed by unscrewing the fixing screw 38 from the projection 16, inserting a screwdriver into the cylindrical body 26 to rotate the weight member 32, moving the weight member 32 in the directions indicated by a two-headed arrow X in FIG. 1 within the cylindrical body 26 or moving the other end of the cylindrical body 26 along the opening 20 in the directions indicated by arrows Y, and fixing the cylindrical body 26 onto the projection 16 by the fixing screw 38. Also, the weight of the golf club head 10 in this embodiment can be changed by exchanging the weight member in the cylindrical body 26. The insertion portion 28 at one end of the cylindrical body 26 need only be inserted into an appropriate rounded groove 24 in accordance with the position of the other end of the cylindrical body 26.

Figure 6:
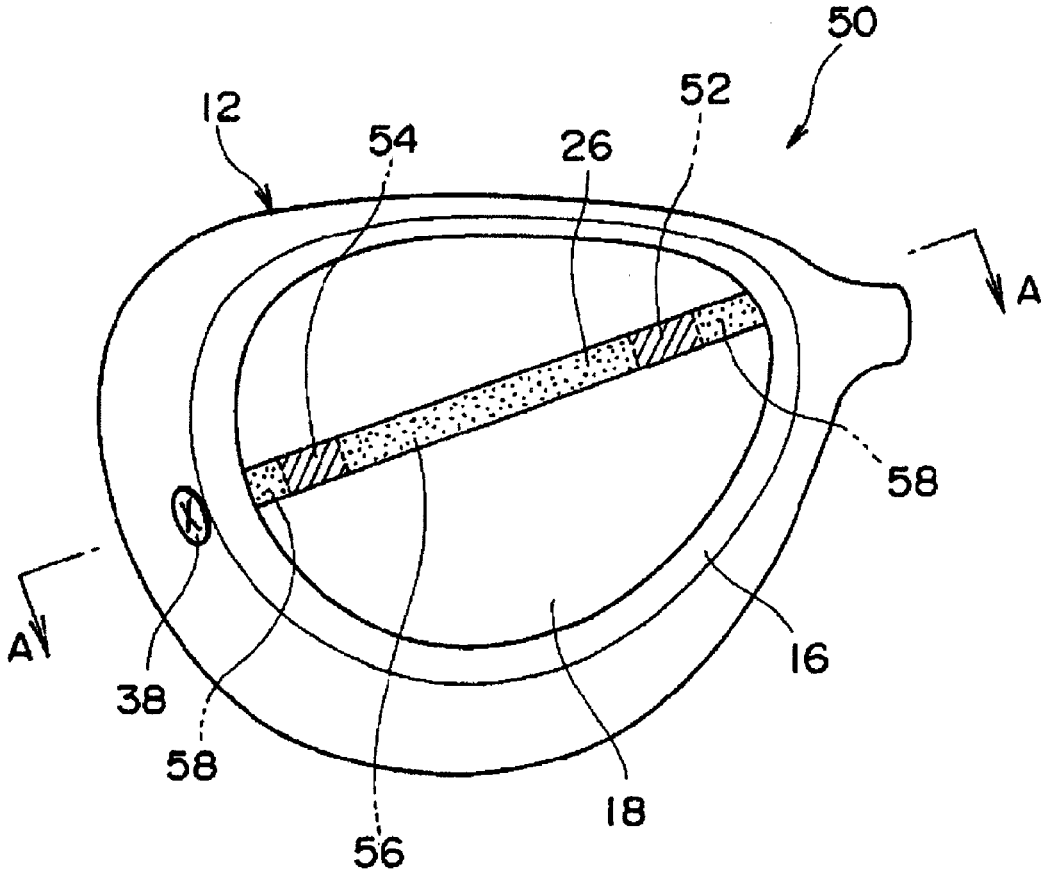
FIG. 6 is a bottom view illustrating another embodiment of a golf club head according to the present invention when viewed from the sole side.

FIG. 6 is a bottom view illustrating another embodiment of a golf club head according to the present invention when viewed from the sole side. A golf club head 50 in this embodiment is formed by distributed loading of weight members by disposing one weight member 52 which is made of, for example, a tungsten alloy and has a high specific gravity, within the cylindrical body 26 on the heel side, and disposing another weight member 54 which is made of, for example, a tungsten alloy and has a high specific gravity, within the cylindrical body 26 on the toe side. Distributed loading of weight members in this way advantageously allows a golf club having the golf club head in this embodiment to feel lighter in weight during a swing and easier to swing than in concentrated loading although the overall center-of-gravity position is the same because of the differences in weight feeling during a swing and in swing feeling between clubs applied with concentrated and distributed loads. Moreover, both the weight members 52 and 54 are prevented from moving within the cylindrical body 26 during, for example, a swing by interposing a weight member (resin screw) 56 which is made of, for example, nylon and has a low specific gravity between both the weight members 52 and 54 in the cylindrical body 26, and filling the cylindrical body 26 on the outside of both the weight members 52 and 54 with elastic materials 58 such as sponge. Other points in the golf club head 50 in this embodiment are the same as in the golf club head 10 shown in FIG. 1. Hence, the same reference numerals as in FIG. 1 denote the same constituent parts in FIG. 6, and a description thereof will not be given.

While the present invention has been described with reference to exemplary embodiments, it is to be understood that the invention is not limited to the disclosed exemplary embodiments. For example, although one cylindrical body is provided in the recess in the above-described embodiments, a plurality of cylindrical bodies may be provided in the recess. Also, the length of the opening extending from the toe side to the back side can be set arbitrarily. The scope of the following claims is to be accorded the broadest interpretation so as to encompass all such modifications and equivalent structures and functions.

This application claims the benefit of Japanese Patent Application No. 2009-152086, filed Jun. 26, 2009, which is hereby incorporated by reference herein in its entirety.

What is claimed is:

1. A golf club head comprising:

a hollow head body including a projection formed along a periphery of a sole, a recess formed inside said projection, and an opening formed in said projection so as to extend from a toe side to a back side;

a cylindrical body which is provided in said recess of said head body, includes one end that engages with an inner wall of said projection on a heel side, and the other end that extends to a vicinity of said opening and can move along said opening;

a weight member retractably, detachably inserted in said cylindrical body; and a detachable fixing member which fixes said other end of said cylindrical body onto said projection.

2. The head according to claim 1, wherein a plurality of weight members retractably, detachably engage with a thread on an inner wall of said cylindrical body.

3. A golf club head comprising:

a hollow head body including a projection formed along a periphery of a sole, a recess formed inside said projection, an opening formed in said projection so as to extend from a toe side to a back side, a thread formed on an inner wall of said opening, and at least one groove portion formed in an inner wall of said projection on a heel side;

a cylindrical body which is provided in said recess of said head body, includes one end inserted in said groove portion, the other end that extends to a vicinity of said opening and can move along said opening, and a thread formed on an inner wall thereof;

a weight member which includes a thread formed on an outer wall thereof and retractably, detachably engages with said thread on the inner wall of said cylindrical body; and a detachable fixing screw which engages with said thread in said opening from outside said projection, and presses said other end of said cylindrical body to push said one end of said cylindrical body against said groove portion, thereby fixing said cylindrical body onto said projection.

4. The head according to claim 3, wherein a plurality of weight members retractably, detachably engage with said thread on the inner wall of said cylindrical body.

* * * * *